United States Patent [19]

McGregor

[11] Patent Number: 5,029,804

[45] Date of Patent: Jul. 9, 1991

[54] IN SITU BRICK OR BLOCK MAKING FORMWORK

[76] Inventor: Stephen P. McGregor, 27 Davidson Road, Katoomba, New South Wales 2750, Australia

[21] Appl. No.: 348,724

[22] PCT Filed: Oct. 16, 1987

[86] PCT No.: PCT/AU87/00350

§ 371 Date: Apr. 4, 1989

§ 102(e) Date: Apr. 4, 1989

[87] PCT Pub. No.: WO88/02802

PCT Pub. Date: Apr. 21, 1988

[30] Foreign Application Priority Data

Oct. 16, 1986 [AU] Australia ..... PH8517
Jun. 1, 1987 [AU] Australia ..... PI2256

[51] Int. Cl.[5] ..... B28B 7/00
[52] U.S. Cl. ..... 249/20; 264/33
[58] Field of Search ..... 264/33-35, 264/333, 261; 249/13, 19, 20, 33, 122, 98, 99, 101, 142; 52/426, 437, 747, 442, 743

[56] References Cited

U.S. PATENT DOCUMENTS

| | | | |
|---|---|---|---|
| 918,231 | 4/1909 | Warren | 264/33 |
| 936,798 | 10/1909 | Mueller | 249/20 |
| 1,233,241 | 7/1917 | Irey | 249/99 |
| 1,413,169 | 4/1922 | Lawton | 52/437 |
| 1.423,461 | 7/1922 | Scruby et al. | 249/21 |
| 1,655,676 | 1/1928 | Daggett | 264/33 |
| 1,706,647 | 3/1929 | Besser | 249/142 |
| 1,712,678 | 5/1929 | Redman | 249/20 |
| 1,746,566 | 2/1930 | Tufts | 264/34 |
| 1,862,544 | 6/1932 | McWane | 264/33 |
| 2,523,349 | 9/1950 | Wissinger | 249/99 |
| 2,548,935 | 4/1951 | Billner | 264/35 |
| 2,633,621 | 4/1951 | Moss | 264/35 |
| 2,939,500 | 6/1960 | Grant | 264/34 |
| 4,052,031 | 10/1977 | Melfi | 249/19 |
| 4,106,746 | 8/1978 | Baculo | 249/20 |
| 4,185,804 | 1/1980 | Baculo | 249/20 |
| 4,426,061 | 1/1984 | Taggart | 264/35 |

FOREIGN PATENT DOCUMENTS

| | | | |
|---|---|---|---|
| 829215 | 12/1951 | Fed. Rep. of Germany . | |
| 778749 | 3/1935 | France | 52/442 |
| 0624496 | 6/1985 | Japan . | |
| 1377353 | 2/1988 | U.S.S.R. . | |
| 1427046 | 9/1988 | U.S.S.R. . | |
| 0172052 | 11/1921 | United Kingdom . | |
| 1030850 | 5/1966 | United Kingdom . | |
| 1436315 | 5/1976 | United Kingdom . | |
| 1438636 | 6/1976 | United Kingdom . | |

OTHER PUBLICATIONS

Evdokimov, N. et al., *Technology of Cast-in-Situ Concrete and Reinforced Concrete,* Moscow, 1980, pp. 158, 159 & 171.

*Primary Examiner*—Willard E. Hoag
*Attorney, Agent, or Firm*—Ladas & Parry

[57] ABSTRACT

A mold for forming walls in situ by forming a wall portion and sequentially moving the mold as the wall is formed. The mold has opposed form walls and partitions which together define a wider space in the middle than adjacent the form walls.

4 Claims, 8 Drawing Sheets

IN SITU BRICK OR BLOCK MAKING FORMWORK

Figure 1:
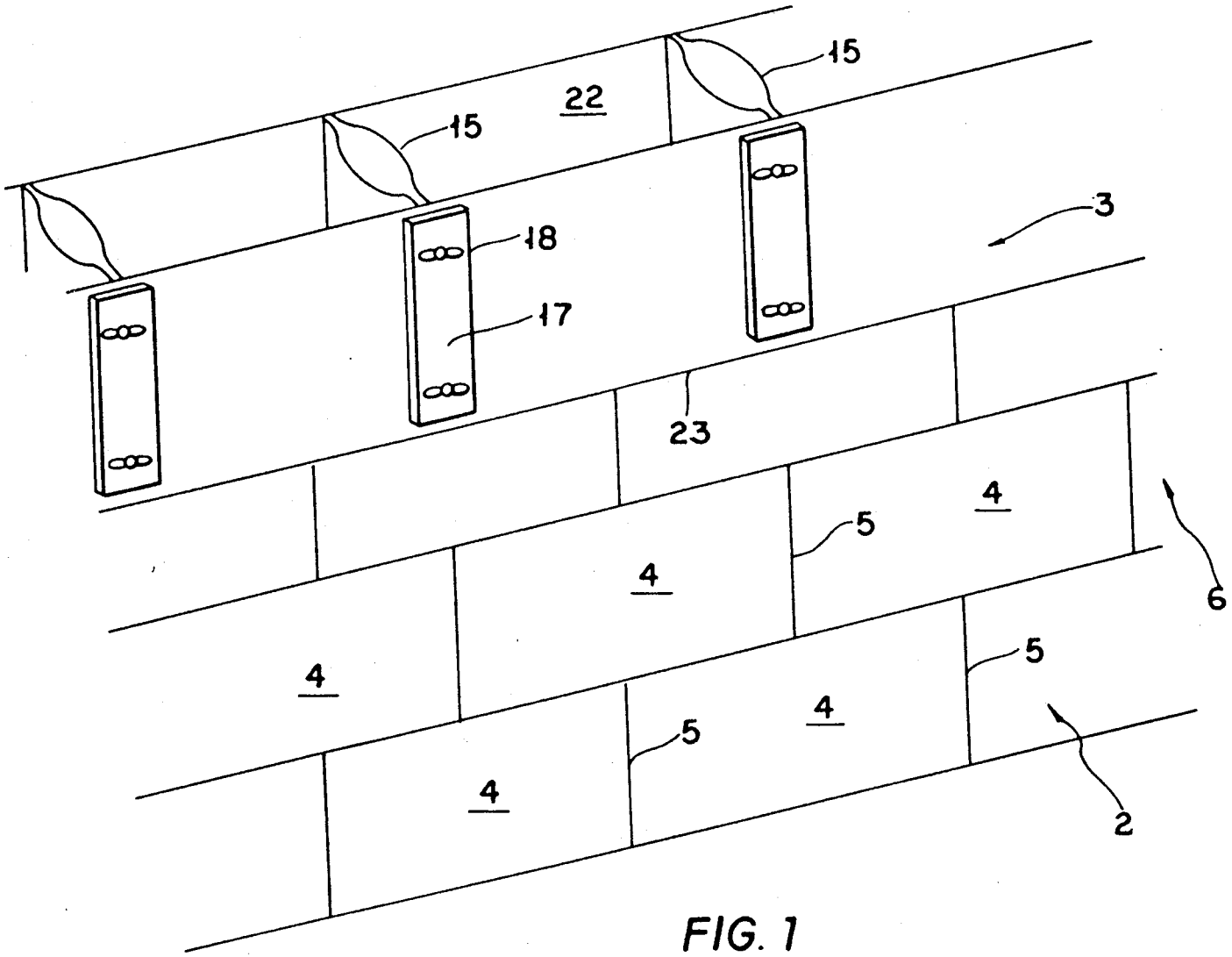

The present invention relates to form work partitioning systems for making bricks or blocks in situ, and in particular, to an improved form work partitioning system which combines the advantages of conventionally laid blocks and the advantages of cast walls.

BACKGROUND ART

In the constructioning industry, the cost and availability of kiln-fired bricks for construction purposes has often necessitated the use of other building materials such as sandstone blocks, wood, fibrous-cement panelling, metal panelling and so on. One form of building material which is both inexpensive and readily available is mud bricks. Another form is cement stabilized earth walls and rammed earth walls.

In the form of construction using mud bricks or blocks, the bricks are usually formed in a mould and are then allowed to dry in the sun until they have hardened to a state ready for construction. The mud-bricks or blocks are then used in a conventional manner and are usually mortared together to form a wall or the like. Such a construction method is very time consuming as the construction and the making of the bricks or blocks are separate procedures.

In the other forms of construction such as cement stabilized earth walls and rammed earth walls, the mud and cement material is cast as a hole by filling prefabricated form work with the suitably hardenable material. One problem with such a structure is that as the material dries and thereby hardens, the material has a tendancy to shrink and cause cracks and therefore shrinkage cracks are a major problem.

OBJECT OF THE INVENTION

It is an object of the present invention to provide an improved form work partitioning system for use in the construction industry which substantially overcomes or ameliorates the abovementioned disadvantages.

DISCLOSURE OF THE INVENTION

According to one aspect of the present invention there is disclosed a framework partitioning system comprising a plurality of vertical formboards in a pair of opposed rows, each said formboard being connected to and spaced apart from adjacent said formboards by one of a plurality of partitions, each said partition being attached to both said opposed rows thereby spacing the opposed rows apart and forming a mould between a pair of adjacent partitions and a pair of opposed formboards, said partitioning system being used to cast blocks in a course by filling the moulds with a hardenable material whilst the said partitioning system is placed above the previously moulded course of blocks, with the lower edges of said formboards overhanging the previously moulded course of blocks, wherein said partitions comprise a partition body which is substantially wider in the center than at the either of the vertical edges and is slightly wider at the upper edge than the lower edge.

According to another aspect of the present invention there is disclosed a method of using the abovementioned partitioning system.

BRIEF DESCRIPTIONS OF THE DRAWINGS

Figure 2:
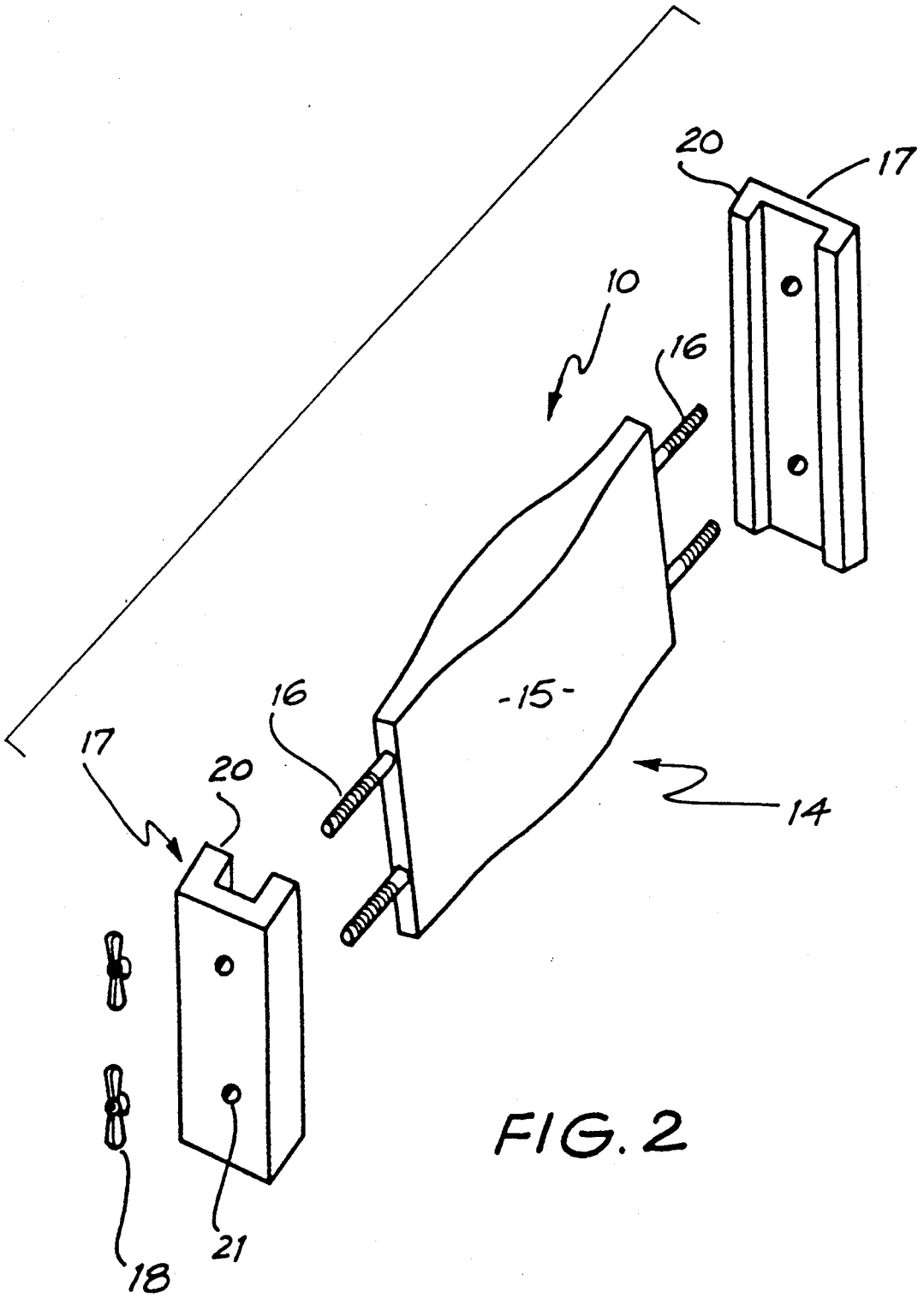
Figure 3:
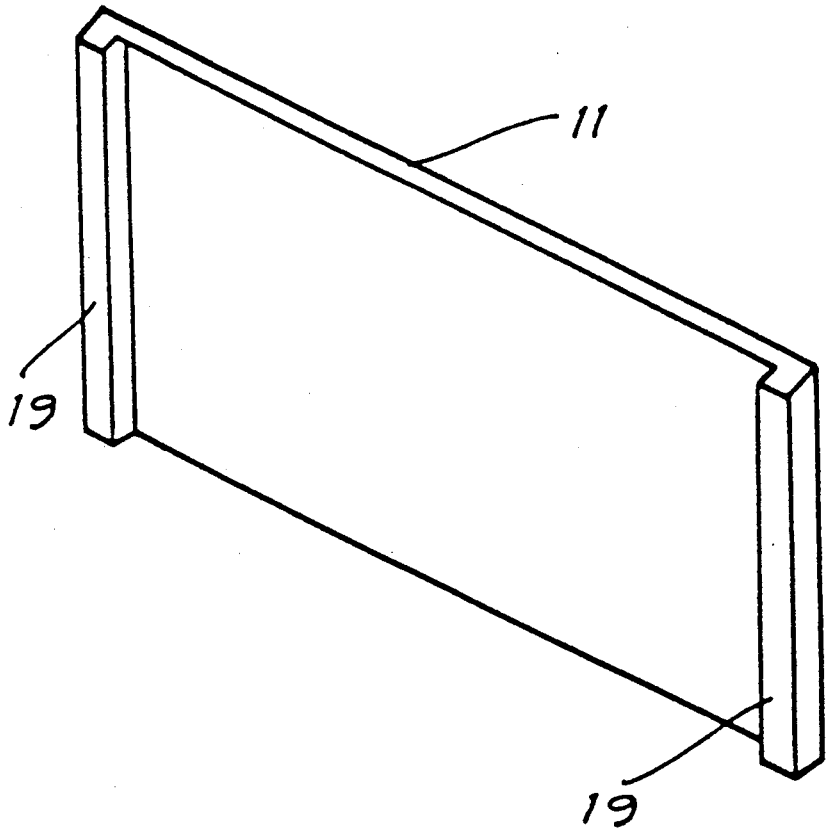
Figure 4:
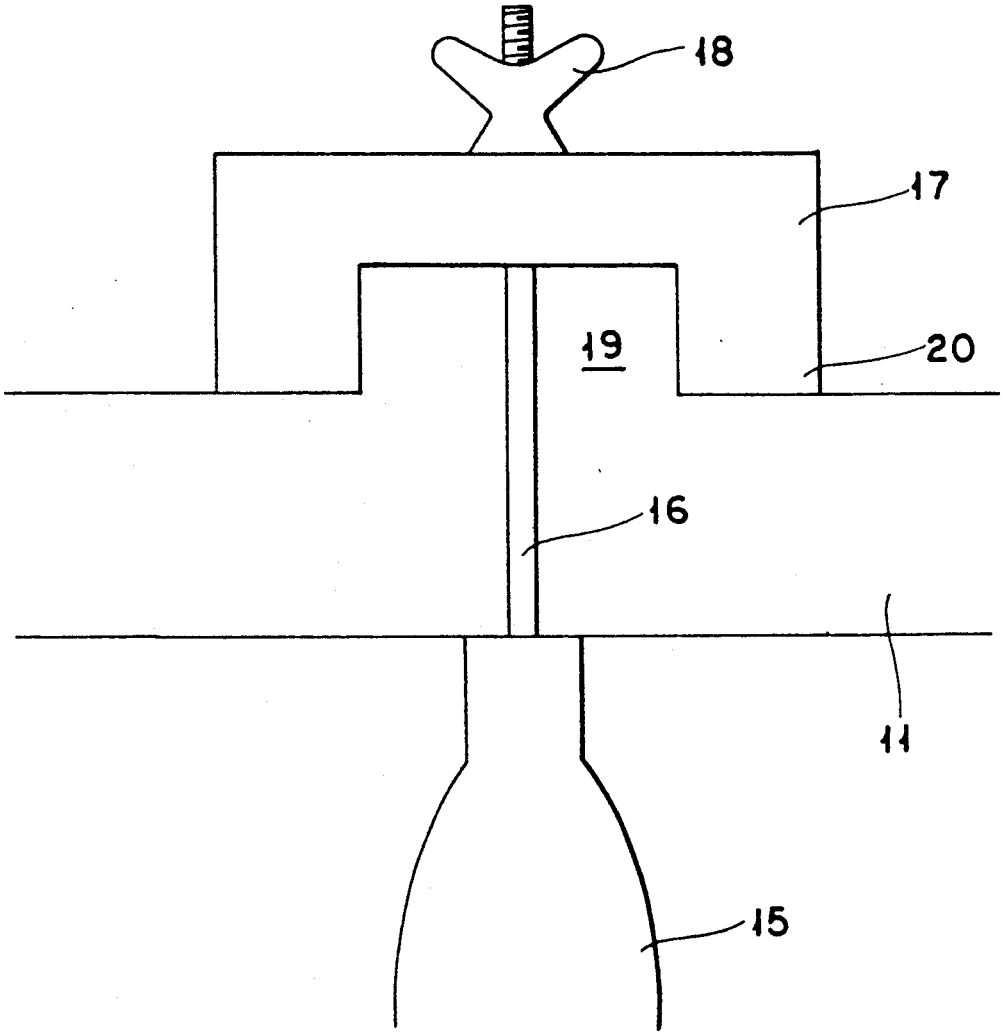
Figure 5:
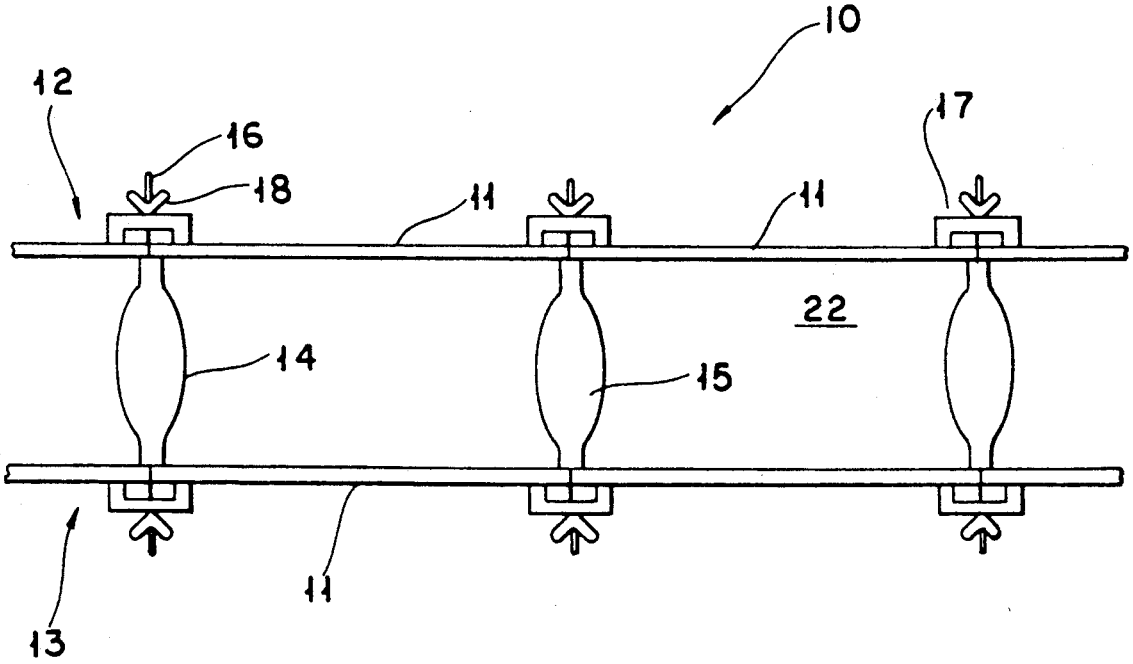
Figure 6:
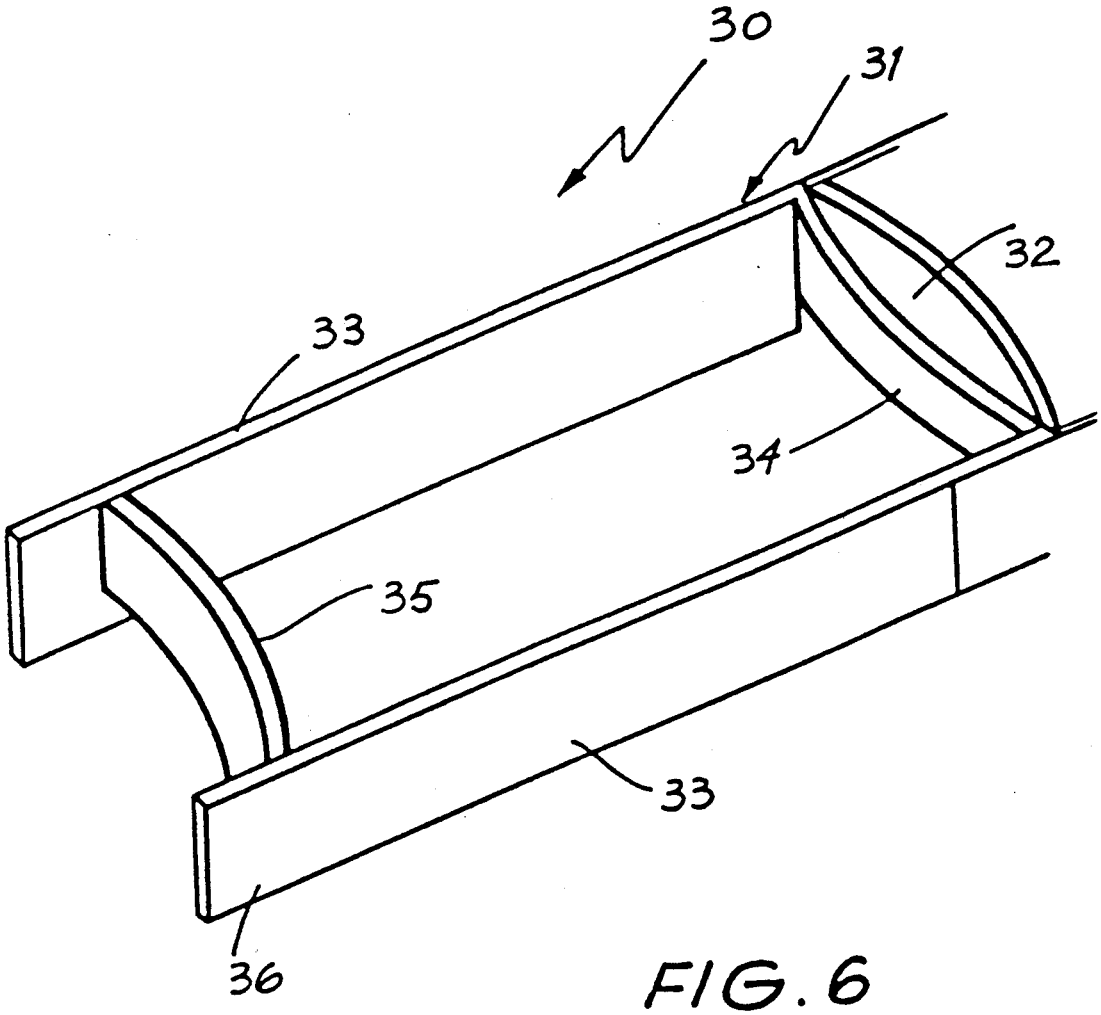
Figure 7:
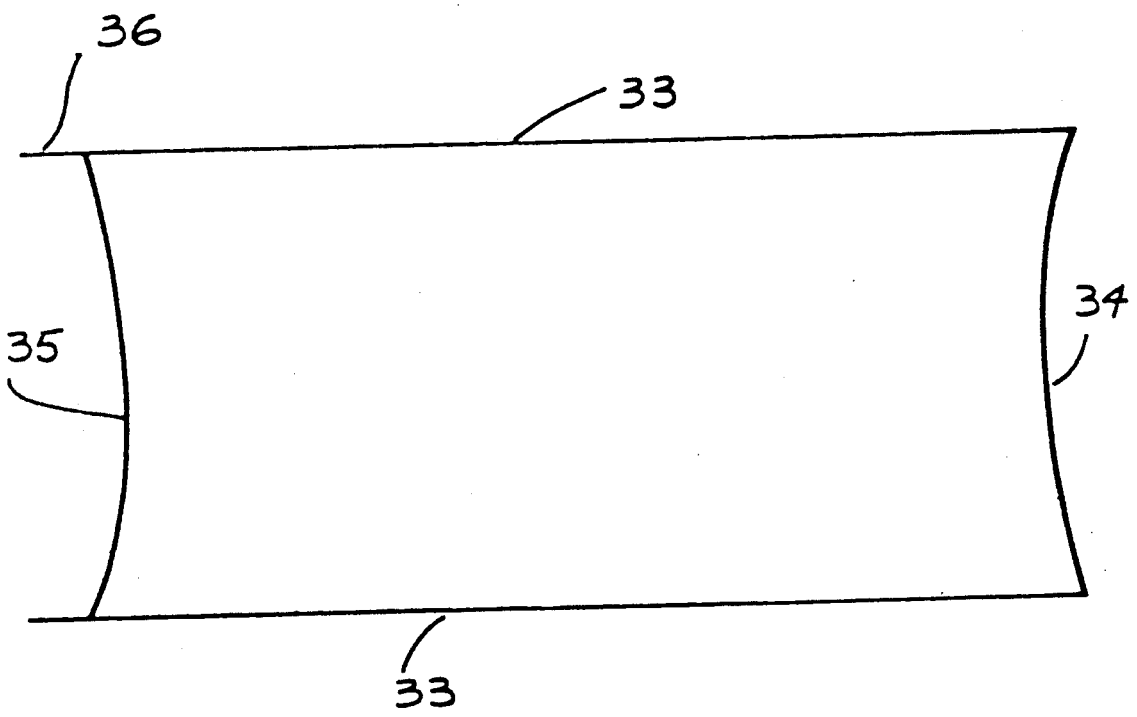
Figure 8:
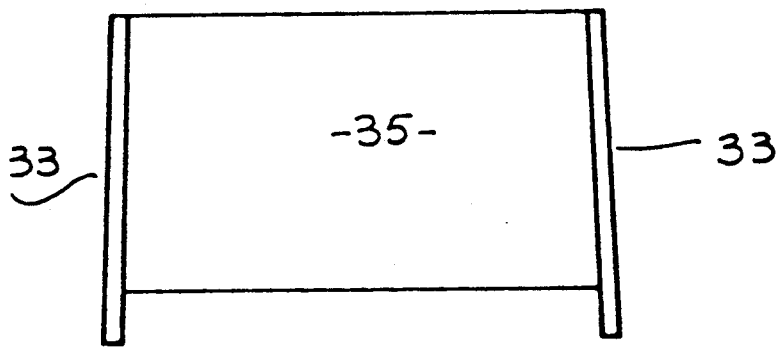

Some embodiments of the present invention will now be described with reference to the drawings in which:

FIG. 1 is a schematic perspective view of a partitioning system of one embodiment in use for construction of blocks in situ on a wall being constructed, FIG. 2 is a perspective view of a partition of one embodiment for use in the system of FIG. 1, FIG. 3 is a perspective view of a form board of one embodiment to use with the partition of FIG. 2, FIG. 4 is a partial plan view showing the connection of the partition of FIG. 2 and two adjacent form boards of FIG. 3, FIG. 5 is a plan view of the partitioning system of FIG. 1, FIG. 6 is a perspective view of a mould of a second embodiment of a partitioning system showing a formwork mould, FIG. 7 is a plan view of the mould of FIG. 6, and FIG. 8 is an end elevational view of the mould of FIG. 6.

BEST MODE OF CARRYING OUT THE INVENTION

As seen in the drawings, the partitioning system is use to construct walls or like structures by forming blocks of hardenable material in situ. A foundation 1 is laid onto which the construction is to be positioned and a first course 2 of blocks 4 is formed by setting up the partitioning system of the present invention onto the foundation 1. The partitioning system formwork 3 is then filled with a hardenable material which is allowed to set inside the formwork 3. Once the material has set to a certain extent the formwork 3 is removed thus allowing the material to dry and harden into the first course 2 of blocks 4. After the blocks 4 have hardened the mortared joints 5 are filled with morter thus providing lateral strength. The formwork 3 is then placed on top of the blocks 4 ready for use to form the next course. This process is continued until the wall 6 is completed by the use and construction of blocks 4 in situ.

One example of a partitioning system which is used to construct the wall 6 as seen in FIG. 1 is illustrated in FIGS. 2 to 5. The system 10 making up the formwork 3 comprises a plurality of formboards 11 which are formed in two opposing rows 12 and 13. The rows 12 and 13 are spaced apart by a partition 14 which also connects adjacent form boards 11 in the same row 12 or 13 together. The partition 14 consists of a body 15 having a pair of projecting bolts 16 at each of its ends. A pair of clamps 17 each having a corresponding pair of holes 21 for fitting over the bolts 16 are used together with wing nuts 18 to clamp the system 10 together. As best illustrated in FIGS. 3 and 4 a pair of adjacent formboards 11 having a lip 19 at each end are fitted next to the bolts 16. The clamp 17 having lips 20 fit over the lips 19 of the formboards 11 with the bolts 16 passing through the holes 21. The wing nuts 18 are used to clamp the partition 14 and the adjacent formboards 11 together.

As illustrated in FIG. 4, the system 10 then forms a plurality of moulds 22 ready to be filled with an hardenable material. The partitions 14 and the clamps 17 are shorter than the formboards 11 and therefore in the first course 2 the lower edges 23 of each of the formboards 11 and partitions 14 line up whilst in the next course the system 10 is put together so that top edges line up. The larger sized formboards 11 allow the lower part 23 of the formboards 11 to clamp over the existing course thereby maintaining an even line of the vertical wall 6. As the clamps 17 are tightened the lips 10 and 20 ensure that the formboards 11 are held against the vertical edge of the partition 14 and at right angles to the partition 14. The partition 14 is slightly thicker at the upper edge than at the lower edge which allows for easy removal of the partition 14 once the locks 4 have hardened. The partition 14 is also thicker in the middle which makes it easy to fill the cavity 24 after the partition 14 has been removed and results in a mortar shape which keys the blocks 4 together. One additional feature is that to straighten to formboards 11 before pouring the hardenable material, it is possible to leave about 5 cm of the formboard 11 projecting above the partitions 14 whereby a strip of timber or the like (not illustrated) of up to a couple of meters and as wide as the wall 6 is placed into the recess resting flat on top of the top edge of the partitions 14. These pieces of timber are removed and the blocks 4 are cast and are replaced following this procedure. This straightening of the form boards 11 is only necessary on the first course 2 although it can be used as a secondary function of slowing down the drying thus improving the strength of the blocks 4.

The combination of the features of the preferred embodiment ensures that the formboards 11 are spaced apart at regular intervals and the formboards 11 are held together in two rows. The partitioning system 10 also ensures that adjacent moulds 22 are linked together for correct horizontal and vertical alignment and as the partition 14 rests on the top of the lower course it holds the moulds 22 at the correct heights for the next course. As the partitioning system 10 has oversized formboards 11 the partitioning system 10 or formboards 14 are held firmly to the lower course to ensure correct vertical alignment.

The system 10 of the present invention combines the advantages of conventionally laid blocks and the advantages of cast walls by confining the shrinkage cracks normally found in cast walls to mortar joints thereby enhancing the appearance of the wall. Shrinkage cracks usually found in cast walls are minimized by virtue of the fact that most of the shrinkage has taken place before the mortar is set.

The lateral strength of cast walls is improved because of the bonding of the courses similar to that found in brick walls. The problem of double handling has been solved by the making of the bricks in situ and the fact that it is possible to link all the formboards 11 for a single course together, thereby making it easier to set out the wall or entire building. This ensures that the walls are vertical and level as the formboards lock together in a straight and rigid manner.

A second embodiment of the partitioning system 30 is illustrated in FIGS. 6 to 8 and comprises a mould 31 that is able to link together in multiples with a cavity 32 able to be cast at the end of each block 4. The cavity 32 is later able to be filled with mortar of the shape that keys the adjacent blocks 4 together. The partitioning system 30 of this embodiment will be able to cast mud blocks and cement stabilized earth bricks in situ.

The mould 31 as illustrated in FIGS. 6 to 8 has two opposing vertical sides 33 and two partition sides 34 and 35 which are curved. All sides of the mould 31 slope slightly out at the lower edges to enable easy removal upwards off a hardened block 4. This also allows the mould 31 to fit over the previous course of blocks 4. The sides 33 of the mould 31 project lower than the partitioning sides 34 and 35, the mould 31 is held laterally in position when fitted over the previous course of blocks 4 as the internal partitioning sides 34 and 35 rest on the blocks 4. At one end 36 of the mould 31 the sides 33 project past the partitioning side 35 and are slightly wider than the other end of the partition side 34 allows the partition side 34 to fit within the projections 36 of the sides 33. This enables the moulds 31 to fit over the end of each other and therefore form a row of moulds 31.

The curved shape of the partition sides 34 and 35 enable the mortar to be easily filled into the resulting cavity from the top after the mould 31 has been removed. The blocks 4 are then bonded as in a conventional brick wall.

INDUSTRIAL APPLICABILITY

The above described embodiments of the present invention are applicable to the construction of mud brick walls, cement stabilized earth walls and rammed earth walls. Thus, the present invention finds particular use in the construction of inexpensive dwellings.

All parts of the partitioning systems are made of hard durable water resistant materials. For example, the main material to be envisaged is wooden form work.

The foregoing describes only some embodiments of the present invention and modifications, obvious to those skilled in the art can be made thereto without departing from the scope of the present invention.

For example, the system 10 can be used to construct a concrete retaining wall, or building with the addition of steel reinforcing rod being vertically threaded through the moulds.

I claim:

1. A molding apparatus comprising a plurality of vertical formboards in a pair of opposed rows, each said formboard being connected to and spaced apart from an adjacent said formboard by one of a plurality of partitions, each said partition being attached to both said opposed rows thereby spacing the opposed rows apart and forming a mould between a pair of adjacent partitions and a pair of opposed formboards, said partitioning apparatus being useable to cast blocks in a course by filling the moulds with a hardenable material, said partitioning apparatus being positionable above the previously moulded course of blocks, with the lower edges of said formboards overhanging the previously moulded course of blocks, wherein said partitions comprise a partition body which is substantially wider in the center than at the either of the vertical edges and is slightly wider at the upper edge than the lower edge.

2. The apparatus as claimed in claim 1 wherein said partitions comprise a pair of opposed curved members each located at different ends of the pair of opposed formboards, said partitions and said formboards forming a substantially rectangular shaped mould, and said moulds being joined together longitudinally so that the formboards align themselves into said pair of rows.

3. The apparatus as claimed in claim 1 further comprising a clamping means being disposed such as to clamp the vertical edges of two adjacent formboards with one of the vertical edges of the partition body, with the adjacent formboards being substantially in the same plane and said partition at substantially right angles to said plane.

4. The apparatus as claimed in claim 3 wherein said partitions are positionable to rest on the lower course of blocks and said formboards overhang the top edges of the blocks to align the blocks into a wall substantially in the same plane.

* * * * *